United States Patent [19]

Klocker

[11] Patent Number: 4,549,586

[45] Date of Patent: Oct. 29, 1985

[54] DEVICE FOR SHAVING WOOD WITH CYLINDER SAWS

[76] Inventor: Leo Klocker, Bongern 10, A6850 Dornbirg, Austria

[21] Appl. No.: 475,155

[22] Filed: Mar. 14, 1983

[51] Int. Cl.[4] ..... B27C 9/04

[52] U.S. Cl. ..... 144/3 R; 144/4; 144/116

[58] Field of Search ..... 408/204, 62; 144/4, 144/208 E, 14, 12, 30, 23, 39, 1 R, 3 R, 116

[56] References Cited

U.S. PATENT DOCUMENTS

| | | | |
|---|---|---|---|
| 2,755,827 | 7/1956 | Gerding | 144/23 X |
| 3,163,190 | 12/1964 | Ervin | 144/4 |
| 3,387,637 | 6/1968 | Ferguson et al. | 144/23 |
| 3,522,826 | 8/1970 | Ervin | 144/4 |
| 4,467,848 | 8/1984 | Schmid | 144/4 |

*Primary Examiner*—W. D. Bray

*Attorney, Agent, or Firm*—Andrus, Sceales, Starke & Sawall

[57] ABSTRACT

With a cylinder saw arranged rotatably in a machine frame, only circular profiles are sawed out of boards and beams. This cylinder saw possesses a toothed arrangement, at least on the front side, and is rotatably supported by support and guide rollers in the machine frame. The outside circumference of the cylinder saw is embraced by a continuous, driven belt. A planing fixture is arranged behind the device for sawing out circular profiles with the aid of the cylinder saw and with this planing fixture any desired concave, convex or straight profile shapes can be milled into circular wooden pieces or boards. The planing fixture consists of four profile planing shafts arranged uniformly distributed on the outer circumference, the axes of which are adjustable relative to the longitudinal central axis of the wooden beam to be processed.

9 Claims, 10 Drawing Figures

DEVICE FOR SHAVING WOOD WITH CYLINDER SAWS

The subject matter of the invention is a device for the shaving of woods with cylinder saws. Such a device is know, for example, by AT-PS 286 602 and AT-PS 299 003. This well-known device is, however, only suited for sawing semicircular profiles because the cylinder saws, arranged in the machine frame in a rotatable manner with support and guide rollers, are supported recessed in the feed plane of the feed table. A totally circular profile cannot be machined with this device, as known. In the inner profile of the cylinder saw a support is provided which is fixed to the machine frame; in the outer region of the support several support rollers are supported rotatably and rest against the inner circumference of the cylinder saw with their outer circumferences. Several other support and guide rollers contact the outside circumference of the cylinder saw, which serve simultaneously to guide the endless belt. Owing to the fact that the belt, in the form of a continuous strap, does not embrace the cylinder saw, the cylinder saw is pressed upward by the force of the belt whereby this force is absorbed by the support rollers of the guide unit which lie against the inner circumference. Such a support of the cylinder saw is costly, difficult to mount and not wear-resistant.

The object of the present invention is the further developing of the type of device initially mentioned so that sawing totally circular profiles is possible.

In order to achieve the foregoing object, the invention is charcterized by the fact that the feed plane created by the feed table underneath the front side of the cylinder saw is adjustable, that the cylinder saw is maintained in a recess of the machine frame in a rotatable manner by means of support and guide rollers and that the belt embraces the outside circumference of the cylinder saw in the form of a continuous strap.

An essential characteristic of the invention presented here is, therefore, that the cylinder saw is open at the inner profile, that is, no support or guide rollers are arranged at the inner profile of the cylinder saw. Because of this, it is possible to machine totally circular profiles, since the tube-shaped cylinder saw now saws off the outside circumference of the wooden beam to be machined, whereby the wooden beam circular profile, trimmed in this manner, is transported towards the back, viewed in the direction of travel through the inner circumference of the cylinder saw. Such machining of totally circular profiles has not been possible using the configuration of the AT-PS 286 602, since totally circular profiles trimmed in such a manner would run up against the guide unit which is arranged at the inner circumference.

In order to transmit the large circumferential and axial forces which act upon the cylinder saw, the invention provides that the belt embraces the outside circumference of the cylinder saw in the form of a continuous strap. Because of this the cylinder saw is not pressed toward the outside, away from the continuous strap, but toward the inside, and that means within the region in which the cylinder saw is embraced by the belt.

A particularly simple embodiment results in a modification of the invention from the fact that the cylinder saw is supported in a rotatable manner in a recess which is open at the top of the machine frame, whereby the belt embraces the region of the outside circumference of the cylinder saw which protrudes from the recess in an upward direction. In this way, the belt pulls the cylinder saw into the region of the recess of the machine frame, so that in this region (region of embrace of the belt) a guide roller which lies against the outside circumference of the cylinder saw can be omitted.

A particularly advantageous transmission of forces results from the fact that with respect to the lengthwise centered axis of the cylinder saw, support rollers are arranged on the machine frame in the region around which the belt wraps, opposite to the outside circumference. With the force exerted onto the cylinder saw by the belt in the region around which the belt wraps, this cylinder saw is, therefore, pressed against the oppositely positioned support roller at the machine frame. Hereby, the result is a distortion-free, statically defined support for the cylinder saw in a vertical direction. In the horizontal direction, other guide rollers are provided laterally, at the outside circumference, which prevent lateral yielding of the cylinder saw.

To exclude the axial shifting of the cylinder saw, it is provided that at the outside circumference of the cylinder saw radial grooves are arranged for engaging the belt, as well as the support and guide rollers. Hereby it is preferred, that the support and guide rollers, viewed in an axial direction (travel direction), are arranged in pairs lying one behind the other on the machine frame.

In a further development of the idea of the invention presented here, it is provided, that an additional toothed arrangement exist at the discharge end of the cylinder saw, the outside diameter of which exceeds the outside diameter of the toothed arrangement at the input side. As a result of this, a two-fold machining of the wooden beam which is to be sawed can be undertaken. Firstly, the wooden beam is roughly trimmed at the input side, while the toothed arrangement existing at the discharge end of the same cylinder saw continues the process of shaving the wooden beam trimmed in this manner, for example smoothing, milling, grooving or another similar procedure.

At the outset it was presented that it is the object of this invention to saw circularly profiled pieces of wood in a particularly simple and cost effective manner with the described device. However, in many applications it may be desired to subsequently machine the circularly profiled boards sawed in this manner. For specific purposes, for example fences, garden sheds, log cabins and so on, it may not be desired to use circularly profiled boards, but rather boards which possess a specific curved profile on the outside circumference when viewed in cross-section and which have a differently shaped profile on the inner side. In this case, it is necessary to put the circularly profiled boards which have been sawed according to the previously described invention through a subsequent machining.

According to another aspect of the invention, it is hereby provided that a planing fixture is arranged, at the discharge end of the travel path, with the cylinder saws, and this planing fixture possesses driven profile planing shafts which conform to the sawed profile of the wooden beam. These profile planing shafts lie on the outside circumference of the circularly sawed wooden beam and trim this beam into the desired shape.

In accordance with a further aspect, it is hereby particularly preferred that four profile planing shafts are arranged uniformly distributed at the outside circumference of the sawed wooden beam and each profile planing shaft is adjustable with regard to its clearance relative to the lengthwise centered axis of the wooden beam. As a result of this, all four sides of the wooden beam or, if desired, just one, two or three sides can be machined. The profile planing shafts can possess either a quarter-circular profile as well as a parabolic profile, or a profile of some other nature.

To simplify the drive system, it is preferred that the profile planing shafts be driven in pairs.

The subject matter of the present invention results not only from the subject matter of the individual patent claims, but also from the varied combination of the individual patent claims.

All details and features disclosed in the disclosure, in particular the spatial formation represented in the drawings, are claimed as being essential to the invention insofar as they are new individually or in combination relative to the state of technology.

In the following, the invention is explained in greater detail with the aid of a drawing which illustrates one exemplary embodiment. Hereby, further features and advantages which are essential to the invention appear from the drawing and its description.

FIGS. 5 to 10 a section through wooden beams or boards, machined with a cylinder saw and a planing fixture, and illustration of their attachment to fixed wall elements.

Figure 1:
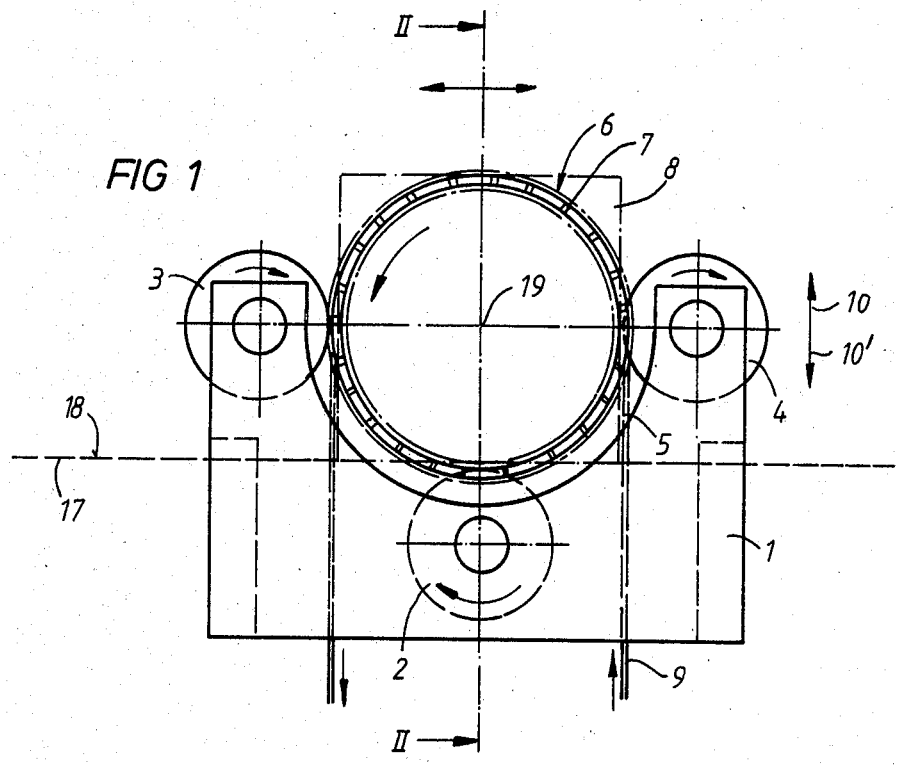
FIG. 1 is a schematically drawn front view of a cylinder saw arranged in a machine frame.
Figure 2:
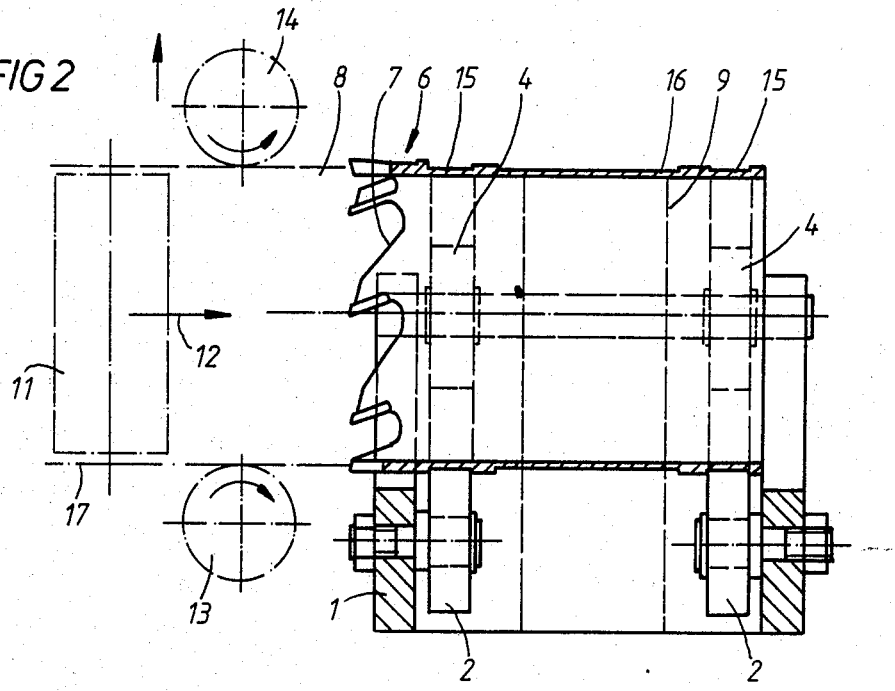
FIG. 2 is a section according to line II—II in FIG. 1.

In FIGS. 1 and 2 only the support of a single cylinder saw 6 on a machine frame 1 is drawn. The accompanying feed tables, discharge tables, guide elements and hold-down devices are omitted for the purpose of simplicity. The corresponding elements of construction are known and are to be taken, for example, from AT-PS 286 602. It is also possible, viewed in the direction of the travel path, to arrange several cylinder saws 6 behind each other, whereby each cylinder saw 6 is then supported in a manner corresponding to the suggestion according to FIGS. 1 and 2.

The cylinder saw 6 is supported in a semicircular recess 5 in the machine frame 1. At the outside circumference of the cylinder saw 6 there lie, radially symmetrically distributed, three rollers. Guide rollers 3, 4 are provided for lateral guidance in the horizontal plane, while a lower support roller 2 bears the cylinder saw 6 in a vertical direction and absorbs the pull which is exerted by the belt 9 which is wrapped around the outside circumference of the cylinder saw 6. The arrangement of three uniformly distributed guide and support rollers 2, 3, 4 is not to be understood as limiting the present idea of the invention, however. It is also possible to arrange more guide rollers 3, 4 at the outside circumference of the cylinder saw 6, in particular it is possible to provide an upper guide roller, which contacts the cylinder saw 6 from above.

The wooden beam 8 which is to be machined is placed onto the feed table 17—which is only schematically outlined—and fed in the direction of the arrow 12 (compare FIG. 2) to the frontally positioned toothed arrangement 7 of the cylinder saw 6. It is, hereby, preferred that the supporting plane 18, which is defined by the feed table 17, lie in approximate alignment with the toothed arrangement 7 of the cylinder saw 6, as shown in FIG. 2 so that the frontal profile of the wooden beam 8 which is to be machined is completely grasped by the toothing 7. In the region of he feed table 17, more support rollers 11 can be provided in order to allow for an easy feed of the wooden beam 8 to the toothed arrangement 7 of the cylinder saw 6. Also for that purpose, lateral guide rollers 13, 14 are provided which guide the wooden beam 8 laterally and which force themselves against its side edges.

The support and guide rollers 2, 3, 4 are arranged in an axial direction in pairs, lying behind each other according to the representation in FIG. 2, in order to avoid a cant of the cylinder saw 6 in axial direction. At the outside circumference of the cylinder saw 6, radial grooves 15, 16 are provided which lie behind each other. A belt 9 meshes into groove 16 while the support and guide rollers 2, 3, 4 mesh into the grooves 15. In this manner the axial shifting of the cylinder saw 6 at the machine frame 1 is excluded The longitudinal central axis 19 of the cylinder saw 6 is thus aligned with the axis of the support roller 2 and this again is in alignment with the axle of the drive wheel for the belt 9 which is not represented in greater detail.

Furthermore, it is provided that the entire machine frame 1 be vertically adjustable with respect to the feed table 17 in the directions of the arrow 10, 10'. In a similar manner, it is possible to adjust the feed table 17 individually in these directions as shown by the arrow.

Another embodiment of the invention, not represented in the drawings, provides that the axes of the support and guide rollers 2, 3, 4 are themselves adjustable in the horizontal and vertical direction, so that cylinder saws 6 of varying diameters can be used. The replacement of the cylinder saw 6 can be carried out in an especially simple manner, because only the belt 9 need be taken off. This could be carried out only with great difficulty with the arrangement existing with the present state of technology, because the guide unit which is arranged in the inner profile of the cylinder saw had to be removed, or the cylinder saw had to be pulled out axially, whereby the constuction components of the machine frame, located in the front and back in the direction of travel, had to be disassembled.

Figure 3:
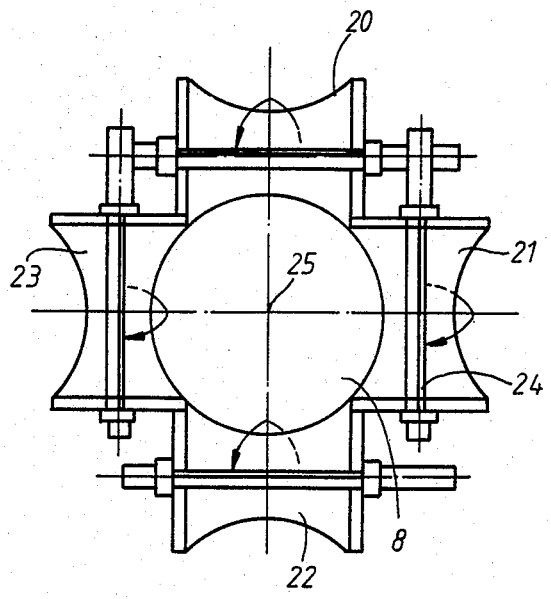
FIG. 3 is a schematically drawn front view of a planing fixture with profile planing shafts.
Figure 4:
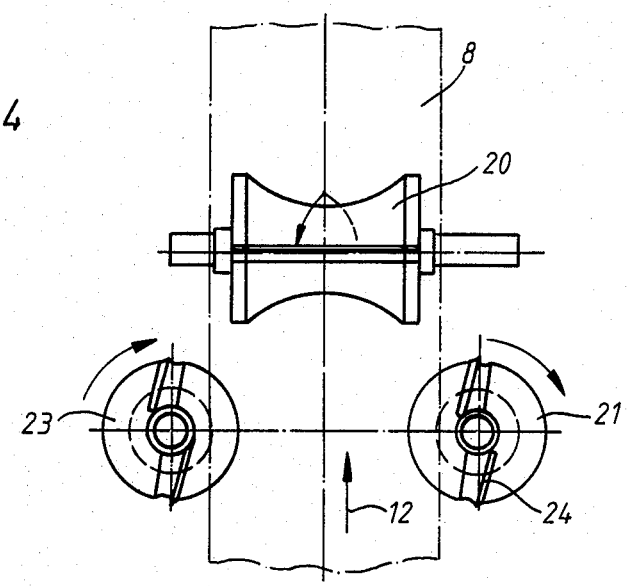
FIG. 4 is a top view onto the device according to FIG. 3.

FIGS. 3 and 4 schematically show a planing fixture arranged behind the cylinder saw 6 according to the exemplary embodiment, consisting of 4 radially symmetrically distributed profile planing shafts 20, 21, 22, 23. Each profile planing shaft 20 to 23 possesses a quarter-circular profile, so that on the sawed out circular profile of the wooden beam 8 in the illustrated example further processing can take place in order to diminish the diameter. The axes of the profile planing shafts 20 to 23 can be engaged individually with respect to the lengthwise centered axis of the wooden beam 8, so that it is possible to employ only one, two, three or four profile planing shafts 20 to 23. Each profile planing shaft possesses at least 2 oppositely lying planing knives 24, with which the process of shaving is carried out.

The profile planing shafts 20 to 23 can be driven selectively, either individually or in pairs. The drive also results by means of drive wheels and drive belts or also by means of other well known drives, as for example, gear units or the like.

FIG. 4 shows that the upper profile planing shaft 20 is arranged behind the lateral profile planing shafts 21, 23 in the direction of travel (direction of arrow 12).

FIGS. 5 to 10 show various profile shapes, as they can be produced with the device according to the invention, that is, by means of the sequential arrangement of the cylinder saw according to FIGS. 1 and 2 as well as a planing fixture according to FIGS. 3 and 4.

Figure 5:
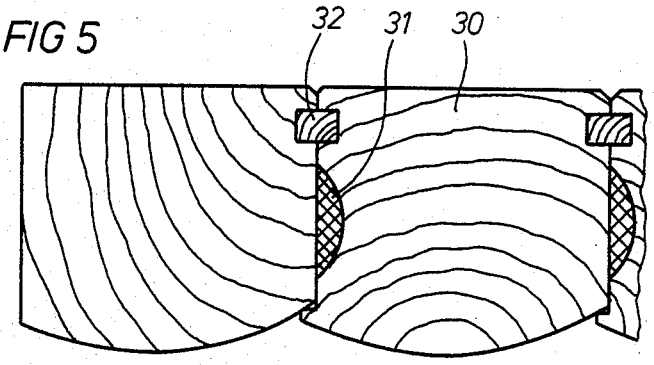

In FIG. 5 it is shown how the wooden wall of a log cabin can be constructed from two profiles 30. Each profile 30 consists of an even inner side and an arched outer side, whereby the connection of both profiles 30 results from the arrangement of adjusting springs 32 in between, and a seal 31.

Figure 6:
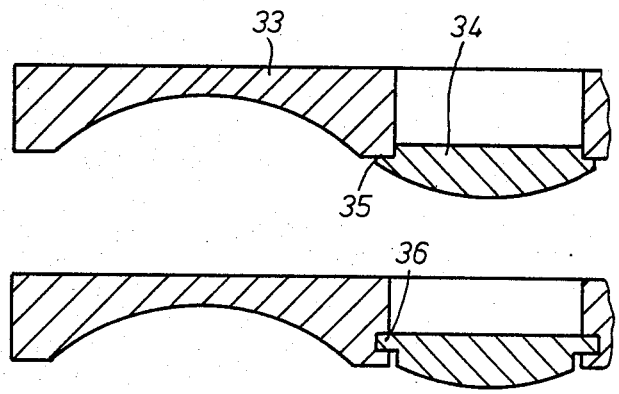
Figure 7:
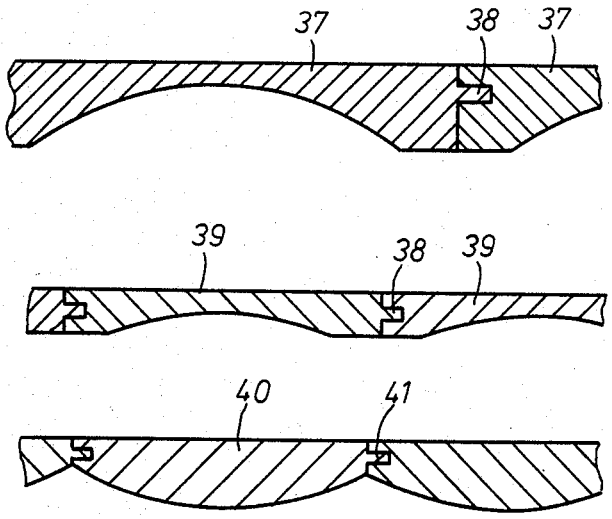

FIGS. 6 and 7 show ceiling and wall paneling also with profiles 33, 34, respectively 37, 39 machined on all sides. The profiles 33, 34 are either connected by a scarf joint 35 or by a tongue and groove joint 36. The profile 33 consists of an even inner side and a concavely (inward) arched outer side. The profile 34 is arched convexly, in contrast to this.

The profile shapes 37, 39, 40 shown in FIG. 7 show similar shapes; they are constructed of similar profile shapes and are connected with each other by scarf joints 38, 41.

Figure 8:
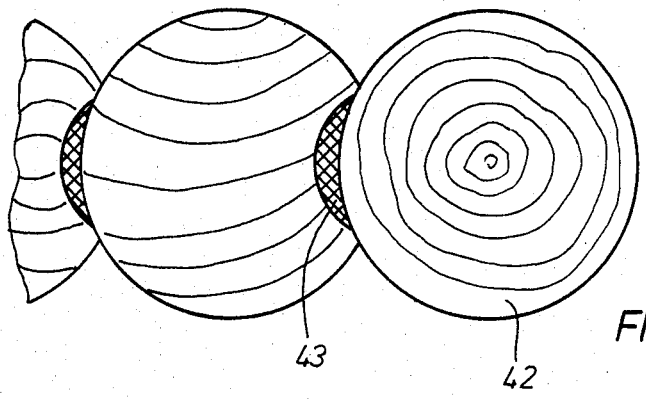
Figure 9:
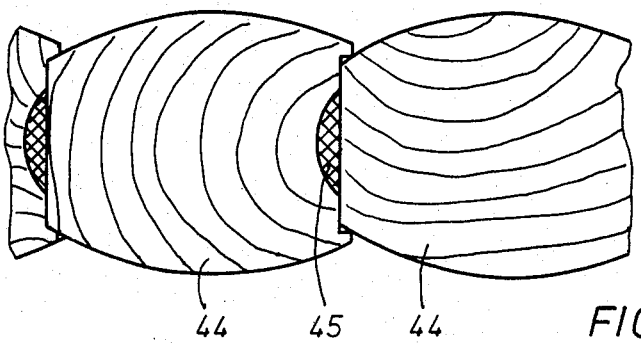
Figure 10:
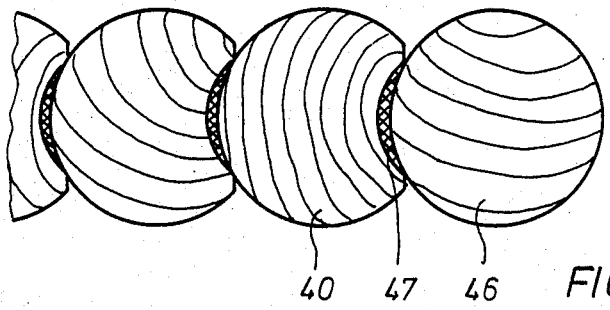

FIGS. 8 to 10 show totally circular profiles with associated connections 43, 45 and 47. The circular profile 42 according to FIG. 8 is designed to serve for the construction of log cabins, just as is the oval profile 44, according to FIG. 9, or the circular profile 46, with the smaller diameter, according to FIG. 10. As a result of the way log cabins are constructed, palisade walls or similar can also be constructed with such circular profiles 42, 44, 46. The seals are indicated by the numbers 31, 43, 47.

I claim:

1. A device for forming the exterior of wooden beams of indeterminate axial length, said device comprising:

at least one drum-like cylindrical saw (6) through the center of which the beam passes from a feed end to a discharge end, said saw having a circular toothed arrangement (7) on said feed end for forming said beam;

a frame (1) having an upwardly open recess (5) for receiving said cylindrical saw (6);

a support roller (2) mounted in said frame (1) beneath said cylindrical saw when same is placed in said recess, said support roller engaging the exterior of said cylindrical saw from beneath for rotatably supporting said cylindrical saw (6) in said frame (1) in a radially and axially unshiftable manner;

a pair of laterally spaced guide rollers (3, 4) mounted in said frame (1) on either side of said cylindrical saw (6) when same is placed in said recess (5), said guide rollers (3, 4) engaging the exterior of said cylindrical saw (6) from opposite sides for coupling said cylindrical saw (6) to said frame (1) in a radially and axially unshiftable manner;

drive means including an endless belt (9) engaging the exterior of said cylindrical saw (6) on an upper portion opposite that engaged by said support roller (2) for rotating said cylindrical saw; and a feed table (17) adjustable in height for axially feeding the beam to said cylindrical saw.

2. A device according to claim 1 wherein the exterior of said cylindrical saw contains circumferential grooves (15, 16) for receiving said support and guide rollers (2, 3, 4) and said drive belt (9) to prevent axial shifting of said cylindrical saw.

3. A device according to claim 1 wherein each of said support and guide rollers (2, 3, 4) comprise a pair of axially spaced rolls mounted in said machine frame (1) and wherein said belt (9) engages the exterior of said cylindrical saw between said axially spaced rolls.

4. A device according to claim 1 further including, at the discharge end of said cylindrical saw (6), a planing fixture including a plurality of driven planing cutters (24) mounted on supports (20, 21, 22, and 23) conforming to the cross section of the beam (8) formed by the cylindrical saw (6).

5. A device according to claim 4 wherein said planing cutters and supports are uniformly arranged about the outside circumference of the formed beam (8) and are radially adjustable with respect to the wooden beam (80.

6. A device according to claim 1, characterized in that the drive means of the belt (9) is arranged underneath the support roller (2) and is aligned with the lengthwise centered axis of the cylindrical saw (6).

7. A device according to claim 1 characterized in that a toothed arrangement exists at the discharge end of the cylinder saw (6), the outside diameter of which exceeds the outside diameter of the toothed arrangement (7) at the input side.

8. A device according to claim 1, characterized in that in the angular range of 180° on the outside circumference of the cylindrical saw (6) three support and guide rollers (2, 3, 4) make contact in a circumferentially symmetrically distributed manner.

9. A device according to claim 4, characterized in that the planing cutters (20, 21, 22, 23) are driven in pairs.

* * * * *.